US011028858B2

(12) United States Patent
Hong et al.

(10) Patent No.: US 11,028,858 B2
(45) Date of Patent: Jun. 8, 2021

(54) INTEGRATED DOWNSTREAM FUNNEL

(71) Applicant: Brose Fahrzeugteile GmbH & Co. Kommanditgesellschaft, Würzburg, Würzburg (DE)

(72) Inventors: Tao Hong, Farmington Hills, MI (US); Attila Simofi-Ilyes, Clarkston, MI (US); John Fleck, Holly, MI (US)

(73) Assignee: Brose Fahrzeugteile GmbH & Co. Kommanditgesellschaft, Würzburg, Würzburg (DE)

( * ) Notice: Subject to any disclaimer, the term of this patent is extended or adjusted under 35 U.S.C. 154(b) by 70 days.

(21) Appl. No.: 16/575,883

(22) Filed: Sep. 19, 2019

(65) Prior Publication Data

US 2021/0088055 A1 Mar. 25, 2021

(51) Int. Cl.
*F04D 29/52* (2006.01)
*F04D 29/54* (2006.01)
*F04D 19/00* (2006.01)

(52) U.S. Cl.
CPC ..... *F04D 29/547* (2013.01); *F04D 19/002* (2013.01); *F04D 29/526* (2013.01)

(58) Field of Classification Search
None
See application file for complete search history.

(56) References Cited

U.S. PATENT DOCUMENTS 5,489,186 A 2/1996 Yapp et al.
5,788,566 A * 8/1998 McAnally ..... H05K 7/20172 361/695
6,343,012 B1 * 1/2002 Rife ..... H01L 23/467 165/185
6,357,247 B1 * 3/2002 Moretti ..... F24F 1/027 62/262
7,478,993 B2 1/2009 Hong et al.
9,884,655 B1 * 2/2018 Nagayoshi ..... B62D 25/084
9,885,368 B2 * 2/2018 Dygert ..... F04D 29/164
10,605,256 B2 * 3/2020 Tyner ..... F04D 29/526
2003/0161728 A1 * 8/2003 Cho ..... F04D 29/685 415/222
2009/0027853 A1 * 1/2009 Simofi-Ilyes ..... H02K 1/278 361/695
2014/0105746 A1 * 4/2014 Findeisen ..... F04D 29/325 416/182
2014/0334917 A1 11/2014 Yoshida et al.
2016/0208674 A1 * 7/2016 Kim ..... F04D 29/326
2018/0202452 A1 * 7/2018 Springer ..... F01P 11/10

FOREIGN PATENT DOCUMENTS

EP 2886872 A1 6/2015
JP 2015038338 A 2/2015
WO WO-2020169546 A1 * 8/2020 ..... F04D 29/164

* cited by examiner

*Primary Examiner* — Michael Lebentritt
(74) *Attorney, Agent, or Firm* — Brooks Kushman, P.C.

(57) ABSTRACT

The fan assembly provided with a fan ring, including a first leg and a second leg, may be arranged with a shroud that may include a first sidewall, a second sidewall, a third sidewall, a first ring, a second ring, and a third ring. An air passage may be formed between a distal end of the first leg and the third ring, the second ring and the first leg, the second leg and the second sidewall, and a distal end of the first leg and the first ring. The air passage may be configured to improve acoustic performance and air flow efficiency.

20 Claims, 6 Drawing Sheets

INTEGRATED DOWNSTREAM FUNNEL

TECHNICAL FIELD

The present disclosure relates to a cooling fan module, in particular one for use with a heat exchanger, such as a radiator, for an automotive vehicle. However, the present disclosure can also be used in other applications such as cooling fan for a home heating and cooling system.

BACKGROUND

Vehicles often include various components that are cooled by a heat exchanger, such as a radiator. Heated air may be drawn or moved away from the radiator by a cooling fan module. Cooling fan modules may include a powered fan that is housed within a frame and operable to move air from an upstream side of the frame to a downstream side of the frame.

SUMMARY

According to one embodiment, a cooling fan module is provided. The cooling fan module may include a fan assembly including blades extending from a hub and terminating at a fan ring. The fan ring may include a first leg that may extend in an axial direction, a second leg, that may extend substantially orthogonally to the first leg, and a curved portion that may extend between the first leg and the second leg. The cooling fan module may include a shroud that may have an upstream side and a downstream side. The fan assembly may be arranged to move air from the upstream side to the downstream side. The shroud may include a first sidewall, a second sidewall, a third sidewall, a first ring, a second ring, and a third ring. The first sidewall may define an opening and the fan assembly may be disposed within the opening. The first ring, the second ring, and the third ring may each extend in an axial direction away from the upstream side. The first ring may extend from the first sidewall and the second ring may be concentrically arranged with respect to the first ring. The third ring may be arranged concentrically with respect to the second ring. The second sidewall may extend between the first ring and the second ring. The third sidewall may extend between the second ring and the third ring. The fan assembly may be arranged with respect to the shroud such that the first leg is concentrically arranged with respect to the second ring and the second leg is spaced apart from the second sidewall in the axial direction.

The second sidewall may extend in a first direction and the first direction may be transverse to the axial direction.

The first direction may be substantially orthogonal to the axial direction.

The cooling fan module may include a strut support member and a strut. The strut support member may extend axially from the first sidewall. The strut may extend radially from the strut support member into the opening. The strut support member may form a partial fourth ring. The partial fourth ring may extend from the third ring.

The second sidewall may bifurcate the first ring.

According to another embodiment, a cooling fan module is provided. The cooling fan module may include a fan assembly including blades extending from a hub and terminating at a fan ring. The fan ring may include a first leg that may extend in an axial direction, a second leg, that may extend substantially orthogonally to the first leg, and a curved portion that may extend between the first leg and the second leg. The shroud may include a first sidewall, a second sidewall, a third sidewall, a first ring, a second ring, and a third ring. The first sidewall may define an opening and the fan assembly may be disposed within the opening. The first ring may extend axially from the first sidewall and the second ring may extend in the axial direction and may be arranged concentrically with respect to the first ring. The third ring may extend in the axial direction and may be arranged concentrically with respect to the second ring. The second leg of the fan may be spaced apart from the second sidewall by a first axial distance. A distal end of the first leg may be spaced apart from the third sidewall by a second axial distance. The first axial distance may be equal to the second axial distance.

The first leg of the fan ring may be spaced apart from the second ring by a first radial-gap distance. The second leg of the fan ring may include a distal end and the distal end may be spaced apart from the first ring by a second radial-gap distance. The first radial-gap distance may be equal to the second radial distance.

The second ring may be spaced apart from the first ring by a first height. The third ring may be spaced apart from the second ring by a second height. The second height may be less than the first height.

The first axial ring may have a first axial length and the second ring may have a second axial length. The second axial length may be greater than the first axial length.

The third ring may have a third axial length that may be less than the second axial length of the second ring.

The third axial length may be less than or equal to one third of the second axial length of the second ring.

DETAILED DESCRIPTION

Figure 1:
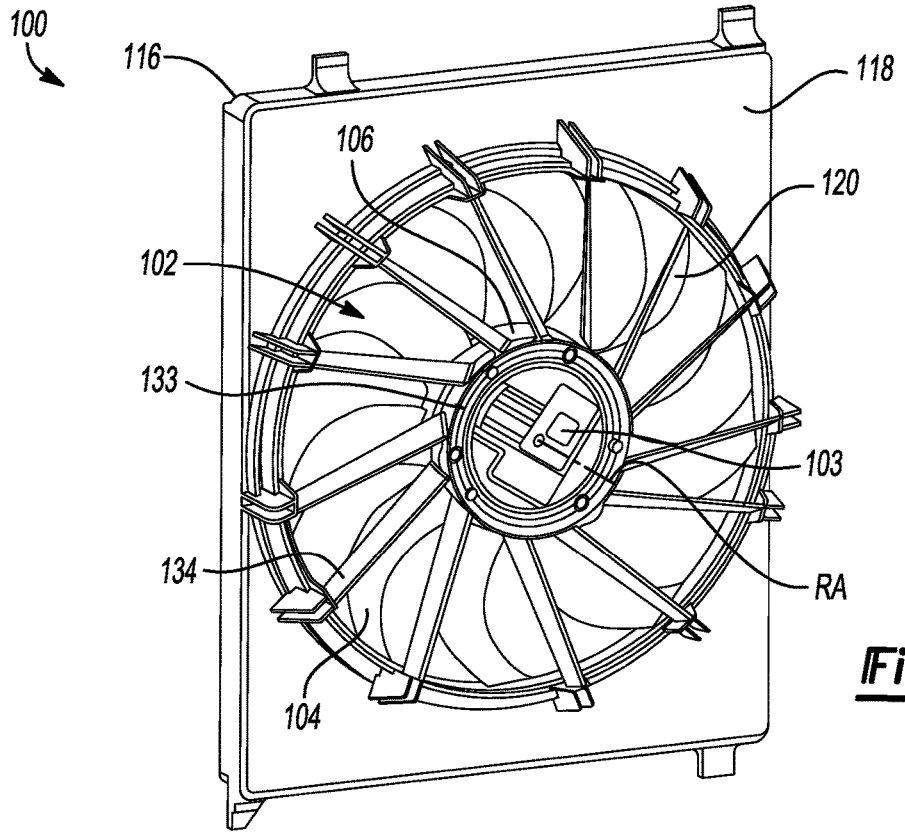
FIG. 1 illustrates a perspective view of an exemplary cooling fan module.
Figure 2:
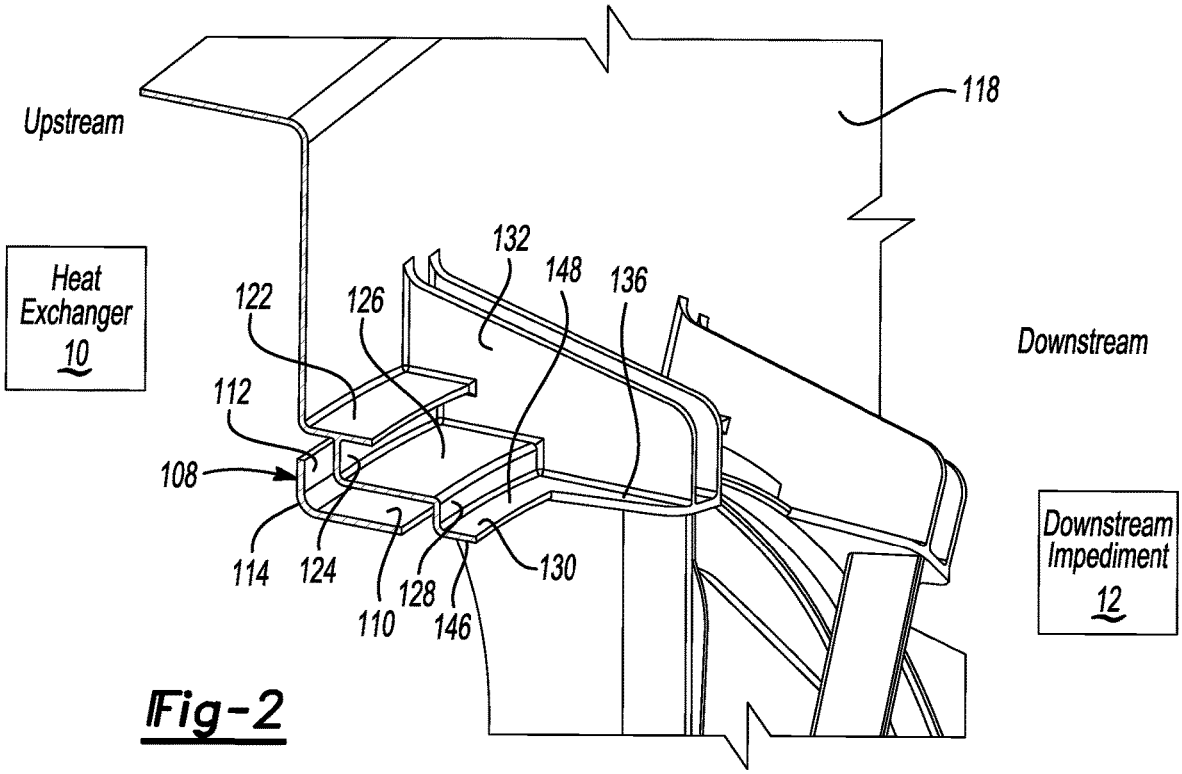
FIG. 2 illustrates a partial-perspective-cross-sectional view of a portion of the cooling fan module illustrated in FIG. 1.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

In the following discussion of the figures, a polar coordinate system is utilized. An axial direction extends along an axis of rotation the fan assembly. A radial direction extends orthogonal to the axial direction from the axis of rotation towards a periphery of the frame of the cooling fan module.

The term orthogonal means one or more surfaces or lines intersect at a right angle or are arranged at a right angle. The term planar means a surface is flat and lies along a plane.

This invention is not limited to the specific embodiments and methods described below, as specific components and/or conditions may, of course, vary. Furthermore, the terminology used herein is used only for the purpose of describing particular embodiments of the present invention and is not intended to be limiting in any way.

As used in the specification and the appended claims, the singular form "a," "an," and "the" comprise plural referents unless the context clearly indicates otherwise. For example, reference to a component in the singular is intended to comprise a plurality of components.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within ±0%, 0.1%, 0.5%, 1%, 2%, 3%, 4%, 5% or 10% of the value or relative characteristic.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Referring generally to the figures, a cooling fan module 100 is provided. The cooling fan module 100 may be configured to move or displace air from a heat exchanger 10 towards a downstream impediment 12. As one example, the heat exchanger 10 may be a radiator or a condenser that may use liquid such as coolant that cools incoming air. The heat source may be an internal combustion engine or an electric motor or other heat generating source. The side of the cooling fan module disposed closest to the radiator may be referred to as the upstream side and the side disposed further away from the radiator may be referred to as the downstream side. In one or more embodiments, the downstream impediment 12 may be an internal combustion engine, an electric machine or motor, one or more batteries, or another vehicle component.

Pressure downstream from the fan may be higher than pressure on the upstream side of the fan. This pressure difference may drive recirculating airflow from the downstream side back to the upstream side through a space between the fan and the opening defined by the frame. This recirculating airflow may be drawn across the fan blades. As a result, tangential airflow velocity may vary, thus decreasing efficiency and leading to unwanted noise.

The cooling fan module 100 may be provided with a fan assembly 102 that may include a number of fan blades 104 that may extend from a hub 106 and terminate at a fan ring 108. As one example, the fan assembly 102 may be driven by an electric motor 103 to rotate the fan assembly 102 about a rotational axis RA, that may be defined by the hub 106, and be configured to move air from the upstream side to the downstream side. The fan ring 108 may include a first leg 110 and a second leg 112 that may extend in a direction that is orthogonal to the first leg 110. The first leg 110 and the second leg 112 may be connected to one another by a curved portion 114.

The cooling fan module 100 may include a shroud 116 that may include a first sidewall 118 that may define an opening 120 and the fan assembly 102 may be disposed within the opening 120. The shroud 116 may also be provided with a number of rings. For example, the shroud may include a first ring 122 that may extend axially from the first sidewall 118 towards the downstream side of the shroud. A second sidewall 124 may extend from the first ring 122 to a second ring 126 that may be arranged concentrically with the first ring 122. In one or more embodiments, the second sidewall 124 may bifurcate the first ring 122. A downstream funnel may be provided and include a third sidewall 128 that may extend between the second ring 126 and a third ring 130 that may be arranged concentrically with the first ring 122, or the second ring 126, or both.

The fan assembly 102 may be arranged with respect to the shroud 116 such that the first leg 110 is concentric to the second ring 126 and the second leg 112 may be axially spaced apart from the first sidewall 118. In other words, the second leg 112 may be at least partially aligned in the axial direction with at least portions of the second sidewall 124 and the first leg may be at least partially aligned in the radial direction with the second ring 126. As one example, the second sidewall 124 may extend in a first direction that may be transverse to the axial direction. The first direction may be substantially orthogonal, forming an approximately ninety-degree angle with the rotational axis RA.

The shroud 116 may include a number of strut support members 132 and a number of struts 134. In one or more embodiments, one or more of the strut support members 132 may extend from the first sidewall 118 in the axial direction and one or more of the struts 134 may extend radially from the strut support member 132 into the opening 120. The struts 134 may be configured to support a motor mounting ring 133. One or more of the strut support members 132 may form a partial fourth ring 136 or portions of a fourth ring 136 that may extend from the third ring 130. The third ring 130 may extend to a distal end of the fourth ring 136 and/or to the strut 134. The third ring 130 may be spaced apart from the first sidewall 118 by a first distance and the partial fourth ring 136 may be spaced further apart from the first sidewall 118 by a second distance that is greater than the first distance.

Figure 3:
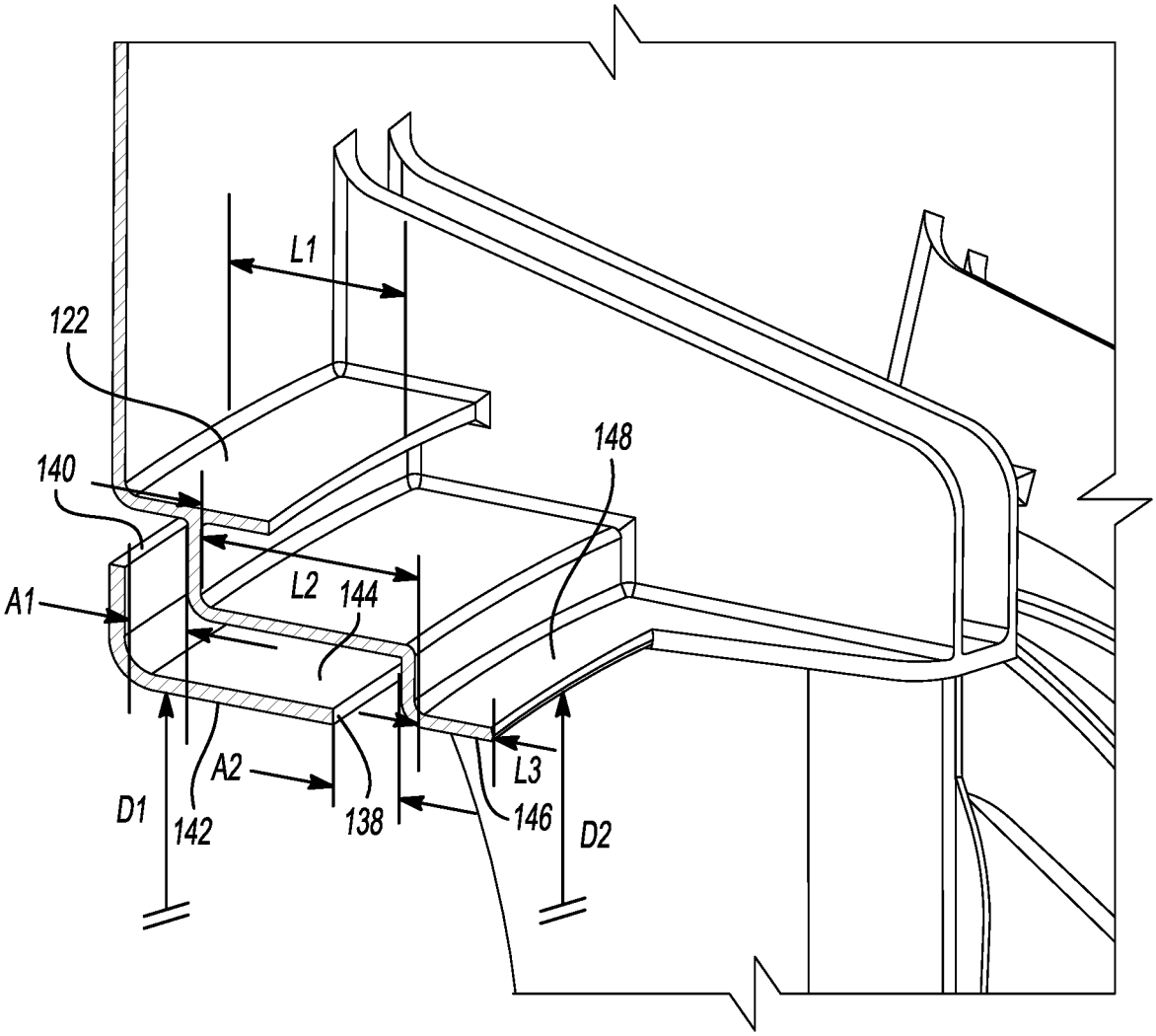
FIG. 3 and FIG. 4 each illustrate a detail-perspective-cross-sectional view of a portion of the cooling fan module illustrated in FIG. 1.
Figure 4:
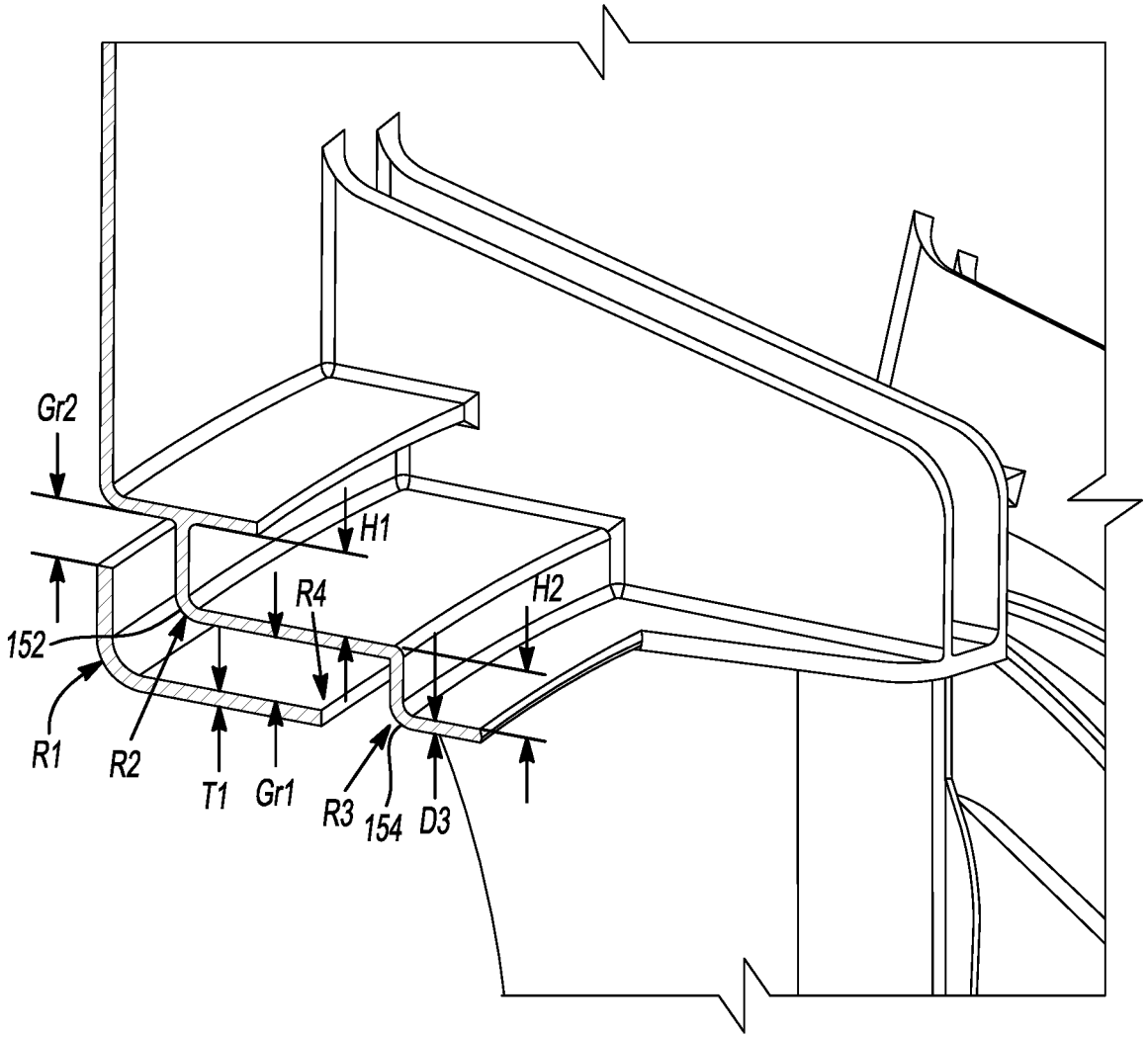

FIG. 3 and FIG. 4 illustrates partial-perspective-cross-sectional views of a portion of the cooling fan module illustrated in FIG. 1. The fan ring 108 may be arranged with respect to the shroud 116 to prevent recirculation of air from the downstream side of the fan shroud 116 to the upstream side. In one or more embodiments, the second leg 112 of the fan ring 108 may be spaced part from the second sidewall 124 by a first axial distance A1. A distal end 138 of the first leg 110 may be spaced apart from the third sidewall by a second axial distance A2. The first axial distance A1 and the second axial distance A2 may be configured such that the fan ring 108 provides an air flow passage from the downstream side to the upstream side. The first leg 110 of the fan ring 108 may be spaced apart from the second ring 126 by a first radial-gap distance Gr1 and a distal end 140 of the second leg 112 of the fan ring 108 may be spaced apart from the first ring 122 by a second radial-gap distance Gr2. As one example, the first radial-gap distance Gr1 and the second radial-gap distance Gr2 may be substantially equal to each other.

The second ring 126 may be spaced apart from the first ring 122 by a first height H1 and the third ring 130 may be spaced apart from the second ring 126 by a second height H2. The second height H2 may be less than the first height H1. The first ring 122 may have a first axial length L1 and the second ring 126 may have a second axial length L2. In one or more embodiments, the first axial length L1 may be greater than the second axial length L2. As one example, the first axial length L1 may be less than or equal to half of the second axial length L2. Additionally, the third ring 130 may have a third axial length L3 that may be less than the second axial length L2. The third axial length L3 may be less than or equal to half of the first axial length L1 of the first ring 122.

The first leg 110 may include an inner portion 142 and an outer portion 144, the inner portion 142 may be disposed closer to the rotational axis RA than the outer portion 144. The third ring 130 may include an inner portion 146 and an outer portion 148, the inner portion 146 may be disposed closer to the rotational axis RA than the outer portion 148. The outer portion 144 of the first leg 110 may be radially offset from the inner portion 146 of the third ring 130 by an offset distance D3. As one example, the outer portion 144 of the first leg 110 may be spaced apart from the rotational axis RA by a first distance that is represented in FIG. 3 by the truncated lead line D1. The inner portion 146 of the third ring 130 may be spaced apart from the rotational axis by a second distance that is represented in FIG. 3 by a truncated lead line D2. The second distance D2 may be greater than the first distance D1. The first leg 110 may have a first thickness T1 and the offset distance D3 may be less than or equal to the first thickness T1. The offset distance D3 may be configured such that air flow is provided from the downstream side to the upstream side and so that recirculation of air flow from the downstream side to the upstream side is mitigated.

The first leg 110 and the second leg 112 of the fan ring 108 may be connected to each other by a curved portion 114 that may have a first radius R1. The second sidewall 124 may be connected to the second ring 126 by a second curved portion 152 that may have a second radius R2. The first radius may be at least two times greater than the second radius R2. The third sidewall 128 and the third ring 130 may be connected to one another by a third curved portion 154 that may have a third radius R3. The third radius R3 may be less than the second radius R2. The distal end 138 of the first leg 110 may have a fourth radius R4 that may be greater than the third radius.

Figure 5:
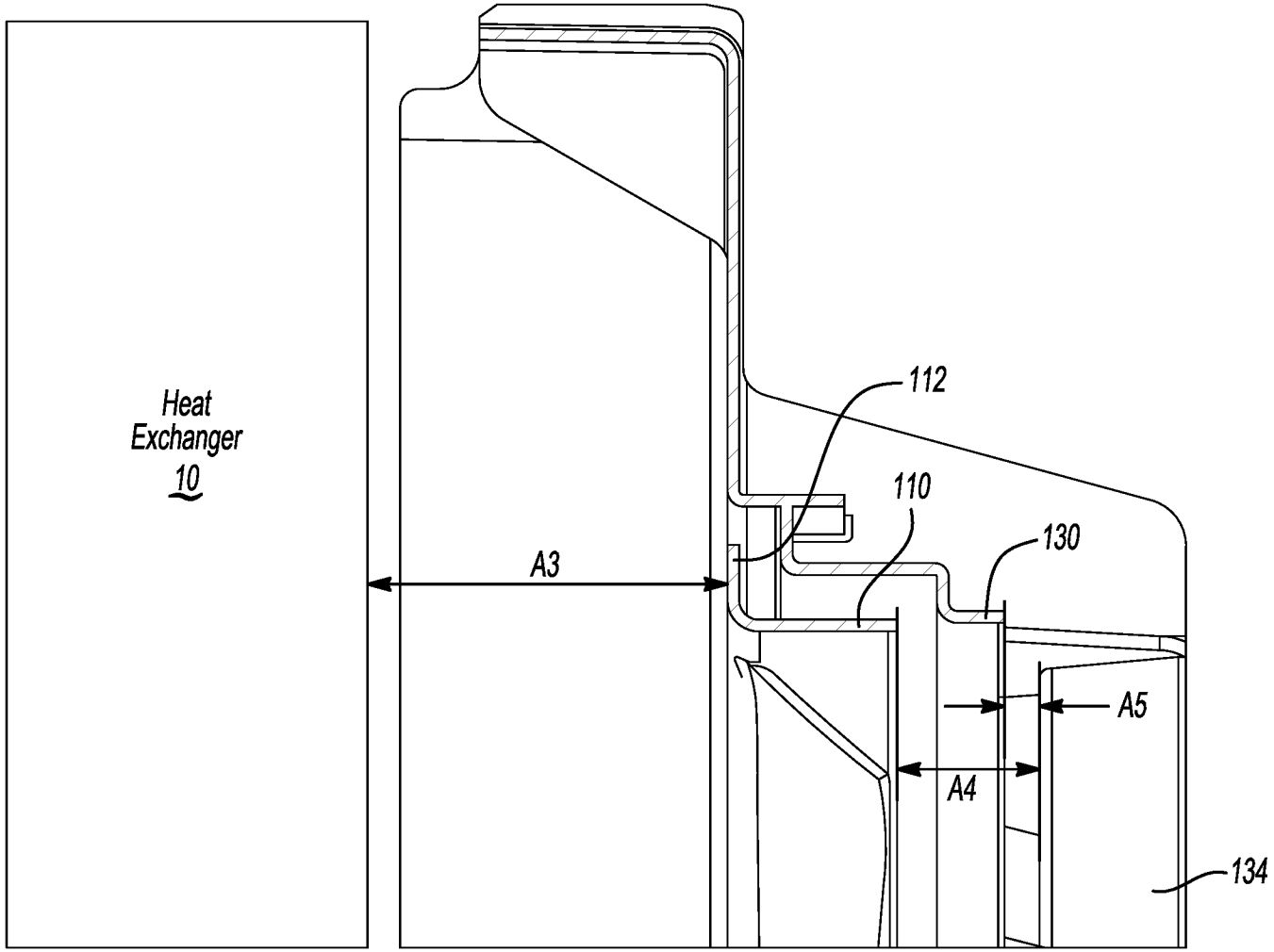
FIG. 5 illustrates a schematic diagram of the cooling fan module and a heat exchanger.

FIG. 5 illustrates a schematic diagram of the cooling fan module 100 and the heat exchanger 10. In one or more embodiments, the distance between various portions of the cooling fan module 100 and the heat exchanger 10 may alter the acoustic performance and overall efficiency of the cooling fan module 100. As one example, the heat exchanger 10 may be spaced apart from the second leg 112 of the fan ring by an axial distance A3. The first leg 110 of the fan ring may be spaced apart from a leading edge of the strut 134 by an axial distance A4 and a trailing edge of the third ring 130 may be spaced apart from the leading edge of the strut 134 by an axial distance A5. As one example, the axial distance A3 may be greater than the axial distances A4 and A5. As another example, the axial distance A4 may be at least two times greater than the axial distance A5.

Figure 6:
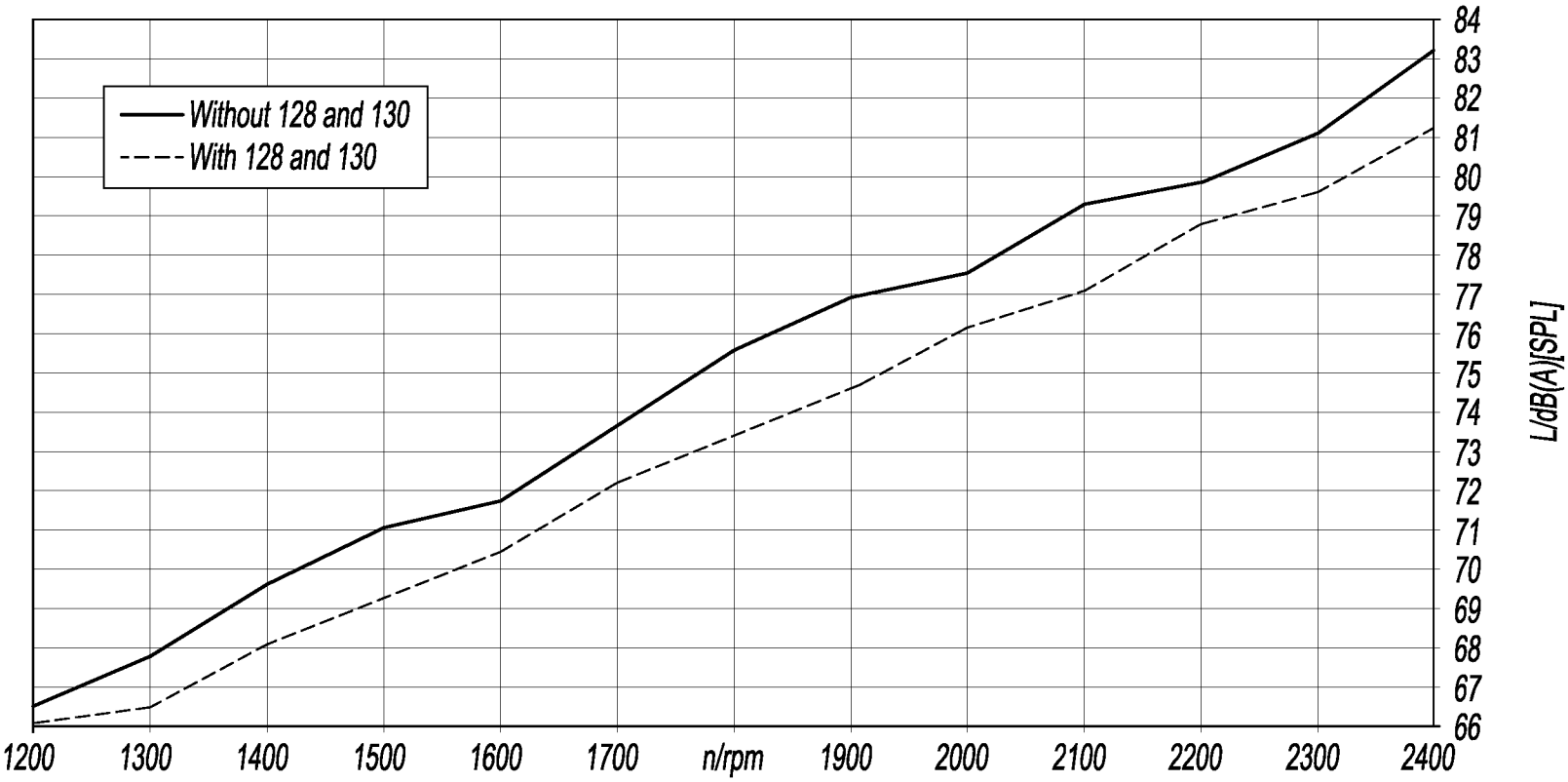
FIG. 6 is a chart illustrating acoustic performance of a cooling fan module with and without the third ring and the third sidewall.
Figure 7:
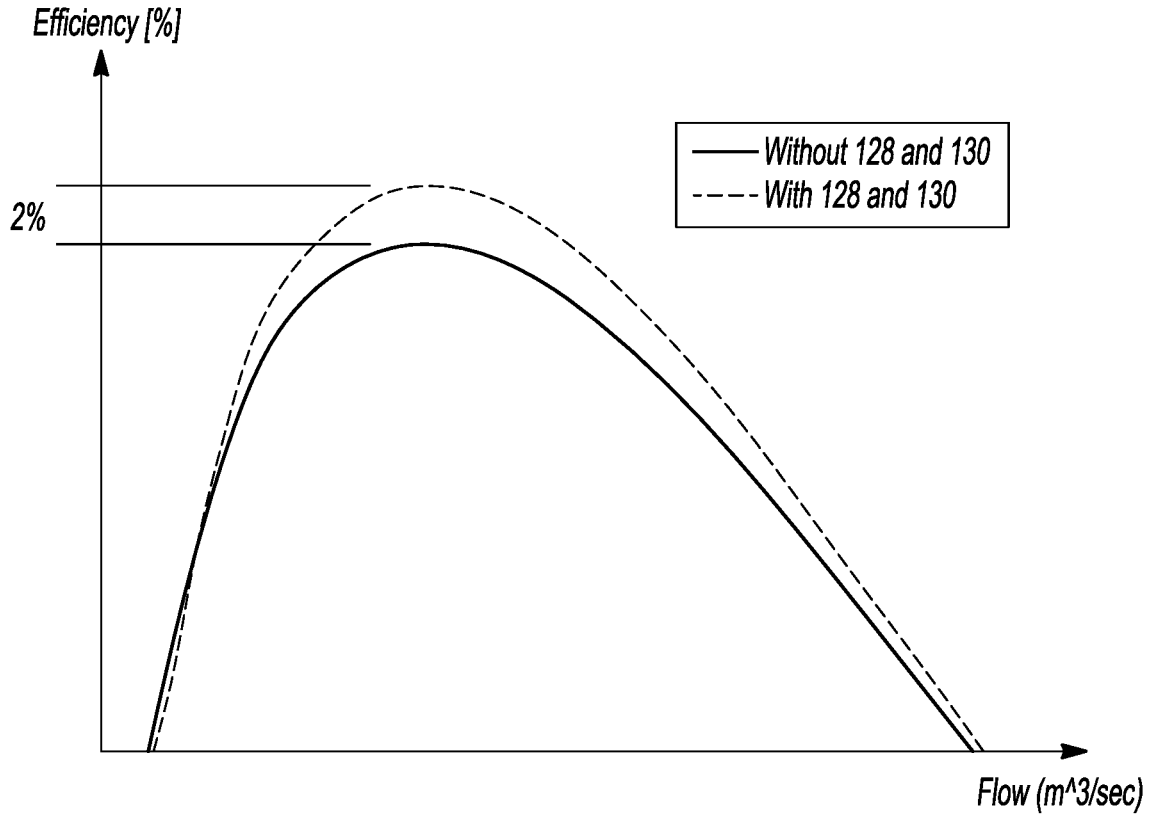
FIG. 7 is a chart illustrating efficiency of a cooling fan module with and without the third ring and the third sidewall.

As one example, the configuration of the cooling fan module described above may result in improved acoustic characteristics and increased efficiency while maintaining a sufficient air power. For example, FIG. 6 illustrates a chart of the acoustic performance of a cooling fan module with and without the third sidewall 128 and third ring 130. The cooling fan module provided with the third sidewall 128 and third ring 130 provides a reduction in overall noise (represented by the Y-axis) of approximately two L/dB(A) between the 1,200 revolutions per minute and 2,400 revolutions per minute (represented by the X-axis). As another example, FIG. 7 illustrates a chart of operating efficiency of the cooling fan module with and without the third sidewall 128 and third ring 130. The cooling fan module provided with the third sidewall 128 and third ring 130 provides approximately a two-percent increase in operating efficiency (represented by the Y-axis) at a predetermined flow rate $m^3$ per seconds.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

PARTS LIST

10 heat exchanger
12 heat source
100 cooling fan module
102 fan assembly
103 electric motor
104 fan blades
106 hub
108 fan ring
110 first leg
112 second leg
114 curved portion
116 shroud
116 fan shroud
118 first sidewall
120 opening

122 first ring
124 second sidewall
126 second ring
128 third sidewall
130 third ring
132 strut support members
133 motor mount ring
134 struts
136 fourth ring
138 distal end
140 distal end
142 inner portion
144 outer portion
146 inner portion
148 outer portion
152 second curved portion
154 third curved portion The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

What is claimed is:

1. A cooling fan module comprising:

a fan assembly including fan blades extending from a hub and terminating at a fan ring, wherein the fan ring includes a first leg, extending in an axial direction, a second leg, extending substantially orthogonally to the first leg, and a curved portion extending therebetween; and a shroud having an upstream side and a downstream side, wherein the fan assembly is arranged to move air from the upstream side to the downstream side, wherein the shroud includes, a first sidewall defining an opening, a first ring, a second ring, and a third ring each extending in an axial direction away from the upstream side, wherein the first ring extends from the first sidewall, wherein the first, second, and third rings are concentric with each other, a second sidewall extending between the first ring and the second ring, and a third sidewall extending between the second ring and the third ring, wherein the fan assembly is arranged with respect to the shroud such that the first leg is concentric to the second ring and the second leg is axially spaced apart from the second sidewall.

2. The cooling fan module of claim 1, wherein the second sidewall extends in a first direction, wherein the first direction is transverse to the axial direction.

3. The cooling fan module of claim 1, wherein the first leg is aligned radially with the second ring.

4. The cooling fan module of claim 1, further comprising:

a strut support member axially extending from the first sidewall; and a strut extending radially extending from the strut support member into the opening, wherein the strut support member forms a partial fourth ring, wherein the partial fourth ring extends from the third ring.

5. The cooling fan module of claim 1, wherein the second sidewall bifurcates the first ring.

6. A cooling fan module for use in a vehicle comprising:

a fan assembly including fan blades extending from a hub and terminating at a fan ring, wherein the fan ring includes a first leg, extending in an axial direction, a second leg, extending substantially orthogonally to the first leg, and a curved portion extending therebetween; and a shroud including, a first sidewall defining an opening, a first ring axially extending from the first sidewall, a second ring extending in the axial direction, a third ring extending in the axial direction, wherein the first, second, and third rings are concentric with each other arranged concentrically with respect to the second ring, a second sidewall extending between the first ring and the second ring, and a third sidewall extending between the second ring and the third ring; and wherein the second leg of the fan ring is spaced apart from the second sidewall by a first axial distance, wherein a distal end of the first leg is spaced apart from the third sidewall by a second axial distance, wherein the first axial distance is substantially equal to the second axial distance.

7. The cooling fan module of claim 6, wherein the first leg of the fan ring is spaced apart from the second ring by a first radial-gap distance, wherein the second leg of the fan ring includes a distal end, wherein the distal end of the second leg is spaced apart from the first ring by a second radial-gap distance, wherein the first radial-gap distance is substantially equal to the second radial distance.

8. The cooling fan module of claim 6, wherein the second ring is spaced apart from the first ring by a first height, wherein the third ring is spaced apart from the second ring by a second height, wherein the second height is less than the first height.

9. The cooling fan module of claim 6, wherein the first ring has a first axial length, wherein the second ring has a second axial length, and wherein the second axial length is greater than the first axial length.

10. The cooling fan module of claim 9, wherein the first axial length is less than or equal to half of the second axial length.

11. The cooling fan module of claim 9, wherein the third ring has a third axial length is less than the second axial length of the second ring.

12. The cooling fan module of claim 11, wherein the third axial length is less than or equal to half of the first axial length of the first ring.

13. The cooling fan module of claim 12, wherein the third axial length is less than or equal to one third of the second axial length of the second ring.

14. A cooling fan module for use in a vehicle comprising:

a fan assembly including fan blades extending from a hub and terminating at a fan ring, wherein the fan ring includes a first leg, extending in an axial direction and a second leg extending substantially orthogonally to the first leg; and a shroud including, a first sidewall defining an opening, a first ring extending from the first sidewall in an axial direction, a second ring extending in the axial direction, a third ring extending in the axial direction and arranged concentrically with respect to the second ring, a second sidewall extending between the first ring and the second ring, and a third sidewall extending between the second ring and the third ring; and wherein an outer portion of the first leg is radially offset from an inner portion of the third ring.

15. The cooling fan module of claim 14, wherein the fan assembly is configured to rotate about a rotational axis, wherein the outer portion of the first leg is spaced apart from the rotational axis by a first distance, wherein an inner portion of the third ring is spaced apart from the rotational axis by a second distance, wherein the second distance is greater than the first distance.

16. The cooling fan module of claim 14, wherein an outer portion of the first leg is radially offset from an inner portion of the third ring by a third distance, wherein the first leg has a first thickness, wherein the third distance is less than or equal to the first thickness.

17. The cooling fan module of claim 14, wherein the first leg and the second leg are connected to one another by a first curved portion having a first radius, wherein second sidewall is connected to a second ring by a second curved portion having a second radius, wherein the first radius is at least two times greater than the second radius.

18. The cooling fan module of claim 17, wherein the third sidewall and the third ring are connected by a third curved portion having a third radius, wherein the third radius is less than the second radius.

19. The cooling fan module of claim 18, wherein a distal end of the first leg has a fourth radius, wherein the fourth radius is greater than third radius.

20. The cooling fan module of claim 14, wherein a passage is formed between a distal end of the first leg and the third ring, the second ring and the first leg, the second leg and the second sidewall, and a distal end of the first leg and the first ring, wherein the passage is configured to improve acoustic performance and air flow efficiency.

* * * * *